United States Patent [19]

Morris

[11] Patent Number: 4,617,063

[45] Date of Patent: Oct. 14, 1986

[54] CLEANING SILVER

[76] Inventor: Brian V. Morris, Britannic House, 28 St. Peters Road, Bournemouth, United Kingdom

[21] Appl. No.: 710,028

[22] Filed: Mar. 11, 1985

[30] Foreign Application Priority Data

Dec. 4, 1984 [GB] United Kingdom ..... 8430594

[51] Int. Cl.[4] ..... B08B 7/00

[52] U.S. Cl. ..... 134/6; 134/29; 252/156

[58] Field of Search ..... 134/6, 29, 2; 252/156

[56] References Cited

U.S. PATENT DOCUMENTS 2,332,497 10/1943 Burkard ..... 252/156
3,145,180 8/1964 Dupré ..... 252/156
3,715,324 2/1973 Hynes ..... 252/156

FOREIGN PATENT DOCUMENTS 569473 2/1934 Fed. Rep. of Germany .

*Primary Examiner*—Andrew H. Metz

*Assistant Examiner*—Sharon T. Cohen

*Attorney, Agent, or Firm*—Trexler, Bushnell & Wolters, Ltd.

[57] ABSTRACT

A method of cleaning a silver or silver-plated article (A) comprises (i) placing at least one piece of aluminium or aluminium alloy (B), preferably a thin sheet with a regular pattern of holes, in a container (C) having a non-metallic inner surface; (ii) adding hot water (D) sufficient to cover the article; (iii) adding sodium carbonate (E); (iv) immersing the article in contact with the aluminium for a brief period, long-ingrained tarnish being (v) gently scrubbed off with a brush; (F); removing the article from the container; (vi) rinsing the article in hot soapy water (G), aided by a mop (H); (vii) rinsing the article with clear hot or cold water (J); and, finally, (viii) polishing the article with a soft clean cloth (K).

The many edges of the holes in the aluminium (B) promote the liberation of nascent hydrogen bubbles (Q) and leads to thorough contacting of the articles (A) with the hydrogen to effect the cleaning by reduction of silver sulphide.

9 Claims, 3 Drawing Figures

CLEANING SILVER

TECHNICAL FIELD

This invention relates to the cleaning of silver or silver-plated articles, and has for its object the provision of a method and means for cleaning silver which quickly removes tarnish from even the smallest crevices, without need to apply cleaning medium by hand, and without being injurous to the metal or the hands.

BACKGROUND ART

German Pat. No. 569 473 acknowledges a method for cleaning silver with the aid of an aluminum contact agent in alkaline solutions, for example solutions containing sodium bicarbonate with or without the addition of soap solutions, and discloses the addition of aldehyde sugar to a solution containing sodium bicarbonate and soap, more particularly 10 g of a mixture comprising 92.5% $NaHCO_3$, 5% powdered medicinal soap and 2½% grape sugar dissolved in 1 liter of water in an aluminium vessel. However, this not only involves having to measure out the four constituents with considerable accuracy, it also results in damage to the aluminium container, even to such an extent around its bottom as to cause it to be holed and become useless.

Tarnish, silver sulphide ($Ag_2S$), is formed as a very thin layer on the surface of silver or silver-plated articles due to the action of hydrogen sulphide ($H_2S$), which is present in the air and also in some mineral waters, according to the equation:

$$2Ag+H_2S=Ag_2S+H_2$$

Silver sulphide is the least soluble in water of all the silver compounds. However, it can be readily reduced by contact with aluminium in dilute sodium carbonate ($Na_2CO_3$) solution, the reduction resulting from the liberation of hydrogen. As sodium carbonate is the salt of a strong base and a weak acid it dissociates to give an alkaline solution.

Hydrogen is likely to be produced via sodium hydroxide (NaOH) as an intermediate according to the equation:

$$Na_2CO_3+2H_2O=H_2CO_3+2NaOH$$

The sodium hydroxide then reacts with the aluminium to give soldium aluminate ($NaAlO_2$) and hydrogen:

$$2NaOH+Al=NaAlO_2+H_2$$

The sodium aluminate appears to ionise as a 1:1 electrolyte:

$$NaAl(OH)_4(H_2O)_2=Na^{+}+[Al(OH)_4(H_2O)_2]$$

The hydrogen evolved will be 'nascent' and, therefore, particularly active as a reducing agent, reduction occurring (obviously) according to the equation:

$$Ag_2S+H_2=2Ag+H_2S$$

the hydrogen sulphide released acting as a weak dibasic acid and being absorbed by the alkaline medium to form either of two salts—sodium sulphide ($Na_2S$) and sodium hydrogen sulphide (NaHS)—depending upon the amount of hydrogen sulphide present:

$$2NaOH+H_2S=Na_2S+2H_2O$$

$$NaOH+H_2S=NaHS+H_2O$$

DISCLOSURE OF INVENTION

The object of the invention is to provide a method and means for cleaning silver or silver-plated articles which overcomes the disadvantages of the German method and which has advantages of its own.

According to the present invention, a method of cleaning a silver article (including a silver-plated article) comprises placing at least one piece of aluminium (or aluminium alloy) in a container having a non-metallic inner surface; adding hot water sufficient to cover the article to be cleaned; adding to the water some sodium carbonate; immersing the article in the water in contact with the aluminium for a brief period; removing the article from the container; and rinsing the article.

Household washing soda ($Na_2CO_3.10H_2O$) may be used, about a dessertspoonful being added for each quart of water used, and in which immersion for one or two minutes will prove effective for the action to clean the article. No evidence has been found that indicates this cleaning method could be harmful, but leaving the article much longer may reverse the process, in which case it should be cleaned with soapy water and reimmersed (in the soda solution and in contact with the aluminium) for a shorter period.

Long-ingrained tarnish can be removed by gently scrubbing the article whilst it is immersed; the rinsing is preferably effected in hot soapy water and can be followed by rinsing with clear water—hot or cold; and, finally the article is preferably polished with a soft clean cloth to give a bright finish.

The piece of aluminium (or aluminium alloy) is preferably a perforate sheet, preferably a thin sheet with a regular pattern of holes, the many edges of which promote the liberation of hydrogen and leads to thorough contacting of the article with hydrogen within the solution. The holes may be circular, or non-circular, e.g., lozenge-shape, provided a balance is established between the amount of metal removed and the aggregate length of edges.

Any candle grease or solid matter should be washed off first or removed with suitable solvent.

The piece of aluminium (or aluminium alloy) can be used again and again, provided it is wiped clean and dried after use and stored in a dry place, for as long as sufficient metal remains to ensure continued action and handleability.

BRIEF DESCRIPTION OF THE DRAWINGS

A method in accordance with the invention and two embodiments of aluminium (or aluminium alloy) for use therein will now be described, by way of example only, with reference to the accompanying drawings, in which.

BEST MODE FOR CARRYING OUT THE INVENTION

Figure 1:
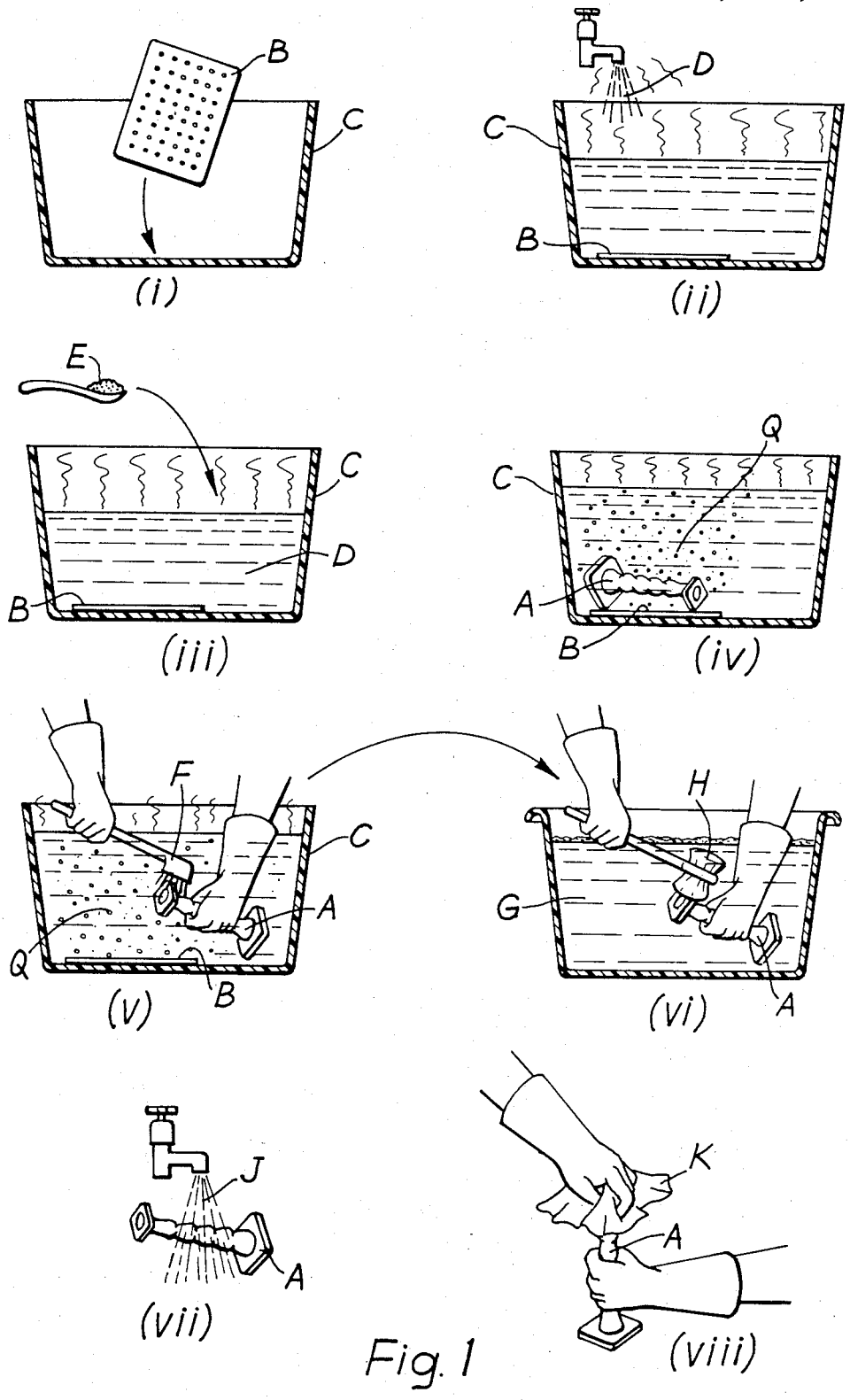
FIG. 1 shows diagrammatically seven stages (i) to (viii) of the method.

In FIG. 1 a method of cleaning a silver or silver-plated article A, which in this case is a candlestick, comprises:

(i) placing at least one piece of aluminium (or aluminium alloy) B in a container having a non-metallic inner surface, which in this case is provided by a plastics bowl C;

(ii) adding hot water D sufficient to cover the article to be cleaned;

(iii) adding to the water some sodium carbonate E;

(iv) immersing the article A in the water in contact with the aluminium B for a brief period, during which time long-ingrained tarnish can be removed by;

(v) gently scrubbing the article A with a suitable brush F whilst it is immersed; removing the article from the container;

(vi) rinsing the article in hot soapy water G, aided—in this case—by a mop H; (vii) rinsing the article with clear hot or cold water J; and, finally, (viii) polishing the article with a soft clean cloth K to give a bright finish.

Figure 2:
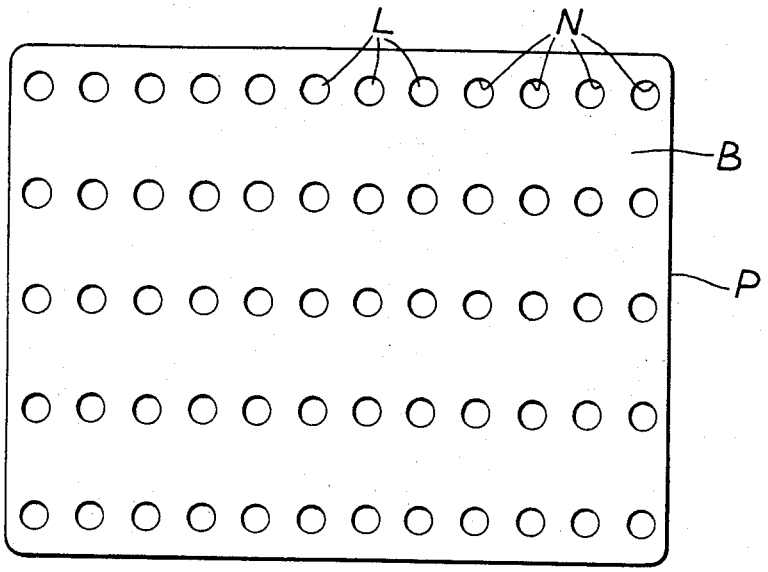
FIGS. 2 and 3 show the embodiments of aluminum (or aluminium alloy).
Figure 3:
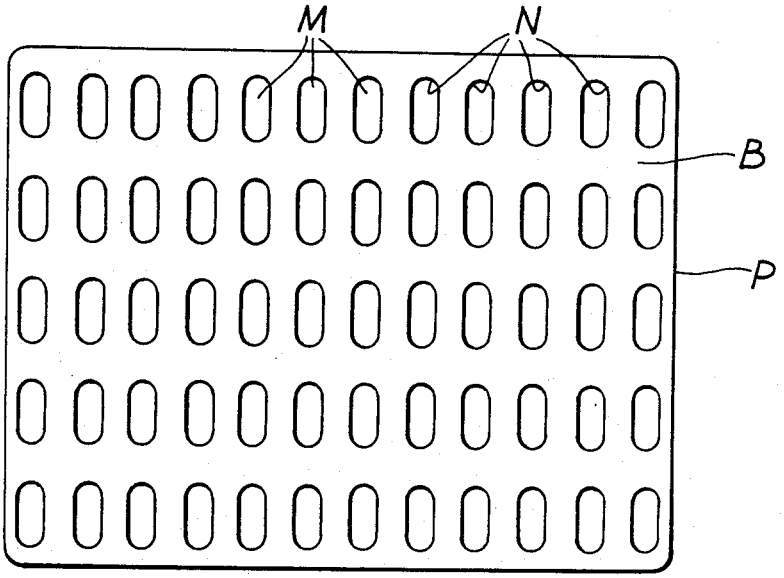

As indicated in FIG. 1(i) the piece of aluminium (or aluminium alloy) B is a perforate sheet, which as more particularly shown in FIG. 2, can have a regular pattern of circular holes L, but the holes could equally be non-circular, e.g., such as the lozenge-shaped holes M in FIG. 3. The many edges N of the holes L or M and the edges P of the plates—when these are immersed in hot water with added sodium carbonate (as in FIG. 1(iii))—promote the liberation of hydrogen—as indicated by the bubbles Q in FIGS. 1(iv) and 1(v)—and lead to a thorough contacting of the article C with hydrogen within the solution, which hydrogen acts as a reducing agent to clean tarnish on the article.

The piece of aluminium (or aluminium alloy) B can be used again and again, provided it is wiped clean and dried after use and stored in a dry place, for as long as sufficient metal remains to ensure continued action and handleability. A balance is established between the amount of metal removed and the aggregate length of edges; thus although the holes L in FIG. 2 provide a lesser aggregate length of edges than the holes M in FIG. 3, the greater metal left in FIG. 2 will mean that this will last longer than that of FIG. 3.

No accurate measuring of hot water and sodium carbonate is needed—just about a desertspoonful of washing soda being added for each quart of water used—which makes the method of the invention much easier to work than that of German Pat. No. 569 473, quite apart from there being no deterioration in the material of the container.

I claim:

1. A method cleaning a silver article comprising placing at least one piece of perforate aluminium in a container having a non-metallic inner surface; adding hot water sufficient to cover the article to be cleaned; adding to the water an amount of sodium carbonate effective to clean the article; immersing the article in the water containing the sodium carbonate in contact with the aluminium for a brief period; removing the article from the container; and rinsing the article.

2. A method as in claim 1, wherein household washing soda is used as the sodium carbonate source.

3. A method as in claim 1, wherein the immersed article is gently scrubbed.

4. A method as in claim 1, wherein the rinsing is effected in hot soapy water and followed by rinsing with clear water.

5. A method as in claim 1, wherein the article is finally polished with a soft clean cloth to give a bright finish.

6. A method as in claim 1, wherein the piece of aluminium is a thin sheet with a regular pattern of holes.

7. A method as in claim 6, wherein the holes are non-circular.

8. A method as in claim 7, wherein the holes are lozenge-shape.

9. A method of cleaning a silver article comprising placing a thin sheet of aluminium with a regular pattern of holes in a container having a non-metallic inner surface; adding hot water sufficient to cover the article to be cleaned; adding to the water about a dessertspoonful of household washing soda for each quart of water; immersing the article in the water in contact with the aluminium for a brief period; gently scrubbing off long-ingrained tarnish while the article is immersed; removing the article from the container; rinsing the article in hot soapy water; rinsing the article with clear water; and, finally, polishing the article with a soft clean cloth to give a bright finish.

* * * * *